US006544300B1

(12) United States Patent
Cliver et al.

(10) Patent No.: US 6,544,300 B1
(45) Date of Patent: Apr. 8, 2003

(54) PROCESS FOR MAKING DYED TEXTILE MATERIALS HAVING HIGH COLORFASTNESS, AND MATERIALS MADE THEREFROM

(75) Inventors: James D. Cliver, Spartanburg, SC (US); Dale R. Williams, Greer, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/472,694

(22) Filed: Dec. 27, 1999

(51) Int. Cl.[7] ..... D06P 5/20; D06P 3/04; D06P 3/52

(52) U.S. Cl. ..... 8/529; 8/922; 8/924; 8/930; 8/933

(58) Field of Search ..... 8/529, 933, 922, 8/924, 930

(56) References Cited

U.S. PATENT DOCUMENTS

| | | | | |
|---|---|---|---|---|
| 4,745,142 | A | 5/1988 | Ohwakie et al. | 524/87 |
| 5,384,082 | A | 1/1995 | Frankfort et al. | 264/103 |
| 5,645,936 | A | 7/1997 | Frankfort et al. | 428/395 |
| 5,855,623 | A | 1/1999 | English et al. | 8/115.56 |
| 5,928,720 | A | 7/1999 | Kuhn et al. | 427/190 |

*Primary Examiner*—Margaret Einsmann
(74) *Attorney, Agent, or Firm*—Terry T. Moyer; Sara M. Current

(57) ABSTRACT

A process for improving the colorfastness of dyed thermoplastic textile materials is described. The process involves heatsetting the materials to a temperature which minimizes the amount of semi-crystalline regions, dyeing the material and subjecting it to a reductive clear. The process can be used on a variety of textile materials including fibers, yarns and fabrics. The process is particularly effective in achieving high colorfastness on microdenier products, even when the product is dyed a dark shade. The materials also retain good strength and flexibility characteristics.

42 Claims, No Drawings

PROCESS FOR MAKING DYED TEXTILE MATERIALS HAVING HIGH COLORFASTNESS, AND MATERIALS MADE THEREFROM

FIELD OF THE INVENTION

The invention generally relates to a process for improving the colorfastness of dyed thermoplastic textile materials, and textile materials having improved colorfastness. More specifically, the invention relates to a process for dyeing textile materials such as microdenier fibers and fabrics made from microdenier fibers, which provides the materials with superior colorfastness capabilities along with desirable strength and aesthetic characteristics.

BACKGROUND OF THE INVENTION

Textile fibers are commonly used in a variety of end uses. In many cases, it is desired that the fibers provide certain visual and aesthetic characteristics, as well as particular functional characteristics. For example, fibers are commonly dyed to achieve particular colors, in order to provide a certain visual appearance to the products which they are used to make.

One problem associated with the dyeing of fibers is that it can be difficult in some cases to achieve good colorfastness while maintaining desired functional characteristics. To this end, the type of dye and processing method used to dye products must be selected to provide the desired end performance characteristics, and optimal levels of particular parameters may have to be sacrificed to achieve acceptable levels of other characteristics.

Recent developments in the synthetic fiber industry have enabled the production of finer denier fibers than heretofore achievable. Such filaments typically have a silkier feel than those of larger size, and therefore can be used to achieve fabrics having improved hand characteristics as compared with those formed from larger filaments. In particular, it has been found that other things being equal, a fabric made from a yarn bundle formed of a plurality of fine denier fibers will generally have a better hand than a fabric made from similarly-sized yarns made from larger denier fibers. Therefore, the demand for microdenier fibers and fabrics made from microdenier fibers continues to increase as their desirability is recognized by consumers and manufacturers.

One disadvantage associated with fine denier fibers (such as microdenier fibers, which are typically considered to be those which have a denier per filament ratio of 1.0 or smaller) is that it is typically more difficult to achieve an equivalent depth of shade when dyeing as compared with their larger counterparts. Such finer denier fibers generally have inferior colorfastness as compared with larger-sized fibers, particularly with darker, deeper shades of dye. As the size of a fiber (i.e. the denier per filament or "dpf") decreases, the proportion of fiber surface area to total fiber composition increases. As a result, a greater percentage of colorant or dyestuff by weight is generally required to achieve an equivalent depth of shade as compared to that required for conventional larger sized fibers.

Dyeability can be particularly difficult to achieve for darker-colored fibers, as such colors typically require the application and retention of an even greater percentage of dye substance. For example, it is not uncommon for microdenier fibers to require the application of as much as three times the amount of dyestuff or colorant as that required for larger fibers, in order to achieve a similar dark shade. Correspondingly, the microdenier fibers typically have lower colorfastness than their larger denier counterparts, which can present problems in their end use. For example, the dyes can be released during subsequent washing of the fibers or articles which they are used to make. Not only does this diminish the integrity of the color of the article, but the freed dye molecules can undesirably attach to other articles in the same wash bath, adversely affecting their color. For this reason, it can be difficult for manufacturers to provide single items incorporating distinct regions of highly contrasting colors, particularly when the regions include microdenier fibers, since the dyes of the darker region tend to bleed onto the lighter colored regions during laundering.

Current practices for addressing the problems associated with the poor colorfastness of microdenier fibers include utilizing expensive high fastness dyes, applying strong reductive chemicals to the fabric or yarn after dyeing, and/or heat treating the fabric to normal heatsetting temperatures (e.g. about 340° to 380° Fahrenheit for polyester) prior to dyeing. Each of these processes will be described more specifically below; all have proven to be insufficient in achieving good coloration and colorfastness on the most difficult shades.

As noted, high colorfastness dyes, which typically utilize benzodifuranone or thiophene structures, etc., can be used to improve colorfastness. However, they are typically much more expensive than conventional dyes. Therefore, it can be difficult to achieve dyed yarns and fabrics using these high colorfastness dyes at desirable levels of cost. Furthermore, the colorfastness achieved by such dyes is still below what would be optimal under normal processing conditions.

Another method for enhancing colorfastness of microdenier materials involves applying a strong reductive chemical to the fabric or yarn after processing. The reductive process or reductive "clear" as it is known, functions to clear and destroy the dye molecules which have not attached securely to the textile material, so that they are not later released. However, the chemicals used in the clearing process can fail to remove all of the weakly attached dye molecules, and therefore they often do not eliminate the problem. In addition, the reductive chemicals can have a deleterious effect on the strength of the fabric. Furthermore, subsequent processes such as drying or heatsetting can liberate additional dye molecules from the fiber structure.

A further method for attempting to enhance the colorfastness of microdenier materials involves pre-heat treating the material at normal heatset temperatures in order to stabilize it for dyeing. For example, polyester is generally heatset at a temperature from about 340° F. to about 380° F. (i.e. about 171° C. to 193° C.) and therefore a pre-heat treatment would generally be performed at these same temperatures. Generally, it is considered to be desirable to minimize the formation of highly crystalline regions, as such are considered to be undyeable. Therefore, it is usually considered to be desirable to minimize the temperature at which the fabric is heatset to the extent possible. This is especially true of microdenier fibers and microdenier fiber-containing fabrics because of the aforementioned problem of greater surface area increasing the dye requirement.

While each of these practices and combinations thereof are considered to assist in improving the colorfastness of the microdenier materials, the colorfastness of such materials is still generally considered to be inferior to that of standard denier filaments. To further improve the colorfastness of microdenier materials, the finished fabrics are in some cases reloaded into a dye machine and treated with a reductive scour. In some cases it has been found that acceptable results can be achieved by this method. However, this process adds the steps of unrolling and batching a set for the dye machine, reloading and scouring, unloading, detwisting and drying, and therefore can be expensive to perform. Furthermore, this process reduces dyeing capacity, adds length to the processing time and is not always successful. In addition, this method creates the risk of causing other off-quality characteristics through the use of so many additional processing steps.

Because of the difficulties associated with obtaining microdenier materials with good colorfastness as noted above, many manufacturers simply limit the depth of shades offered in connection with microdenier fabrics. As will be readily appreciated by those of ordinary skill in the art, this can be unacceptable from an end user's standpoint, since this limits the designers' creative freedom in designing new product offerings.

SUMMARY

The instant invention overcomes many of the disadvantages associated with the prior art constructions by achieving fibers having superior colorfastness properties, while retaining strength and other functional capabilities. In addition, the fabrics made by this method have been found to have a better hand than comparable fabrics made by prior art methods. Furthermore, the instant invention enables the achievement of products having superior colorfastness at comparable levels of cost to products having significantly inferior levels of colorfastness.

As will be readily understood by those of ordinary skill in the art, thermoplastic fibers generally include three molecular phases: highly crystalline, semi-crystalline and amorphous. Conventional wisdom dictated that where textile materials were heatset prior to dyeing, the heating was performed at temperature levels designed to control the formation of crystalline regions within the fiber. However, these processes simultaneously achieved a significant amount of semi-crystalline regions.

In contrast, the instant invention treats the fibers until the molecular structure is to a great extent composed of highly crystalline and amorphous regions and the semi-crystalline phase is minimized. It has been discovered that by minimizing the amount of semi-crystalline regions in the textile materials prior to dyeing, superior colorfastness can be achieved relative to that previously achieved by conventional methods. In particular, it has been found that the highly crystalline phase is essentially undyeable, while the amorphous phase is highly dyeable and has good colorfastness after reductive clearing and washing. The instant inventors have discovered that the semi-crystalline phase is poorly dyeable, and also has poor colorfastness. Therefore, the prior processes, which heatset the textile materials and obtained a significant amount of semi-crystalline phase regions did not achieve optimal dyeability or colorfastness.

In a preferred form of the invention, the textile materials are pre-heatset at temperatures higher than those generally utilized to heat set the particular thermoplastic material, in order to minimize the amount of semi-crystalline regions therein. For example, whereas polyester would typically be heat set at about 340–380° F., the process of the invention heat treats the material to greater than about 380° F., preferably at least about 390° F., more preferably at least about 400° F. and more preferably at least about 410° F.

For purposes of illustration, the process will be described in connection with the dyeing of fabrics. It is noted, however, that the process is equally applicable to the processing of fibers or yarns within the scope of the instant invention.

According to the instant invention, the fabric is desirably processed prior to dyeing to minimize the amount of semi-crystalline regions contained in the fibers. In particular, the fabric is desirably subjected to a heat treatment designed to maximize the proportion of highly crystalline and amorphous regions within the fibers prior to the application of dyes. For example, in the case of a microdenier polyester textile material, the fabric may be subjected to a heat treatment of between about 385° F. and about 430° F., so that the fibers include only a minimal amount of semi-crystalline regions.

The fabric is dyed, such as through the application of commercially-available high wetfast dyestuffs (and in particular, those dyes which are alkaline instable and sensitive to reduction.) Preferably, the dyeing is performed by a batch dyeing process (such as jet dyeing). The fabric is then subjected to reduction bath and rinse treatments sufficient to clear excess dyes away from the fabric, and the fabric is dried.

The resulting textile products, whether in the form of fibers, yarns, fabrics or the like, have improved colorfastness when compared to those made by conventional methods. The textile products also have minimal amount of semi-crystalline regions; preferably the finished fibers include about 8% or less of semi-crystalline phase. More preferably, the fibers include about 5% or less of semi-crystalline phase, even more preferably about 3% or less, even more preferably about 2% or less, and even more preferably about 1% or less. In addition, the functional characteristics (e.g. strength, flexibility, etc.) of the fabrics are comparable to those produced by prior art methods, and the hand is even better, since the heatsetting of the fabric occurs so early in the processing of the textile material. Furthermore, fabrics made according to the invention did not have an unfinished appearance (e.g. such as through the presence of wrinkles), as will be discussed further herein.

DETAILED DESCRIPTION

In the following detailed description of the invention, specific preferred embodiments of the invention are described to enable a full and complete understanding of the invention. It will be recognized that it is not intended to limit the invention to the particular preferred embodiment described, and although specific terms are employed in describing the invention, such terms are used in a descriptive sense for the purpose of illustration and not for the purpose of limitation.

As noted above, conventional wisdom suggested that to improve colorfastness of thermoplastic textile materials, one would try to minimize the amount of highly crystalline regions prior to dyeing to the extent possible, within the parameters needed to achieve the requisite functional characteristics (e.g. strength, flexibility and the like.) However, the instant inventors have discovered that by reducing the percentage of regions which are not highly crystalline or amorphous (i.e. reducing the amount of semi-crystalline regions), greater colorfastness can be achieved, despite the fact that a corresponding increase in the amount of highly crystalline phase may be realized. It is believed by the inventors that the semi-crystalline phase has poor colorfastness and that by reducing or substantially eliminating this molecular phase, textile products having improved dyeability and colorfastness can be achieved.

For purposes of illustration, the examples described below elate to textile fabrics. However, as noted above, the invention would apply to all types of thermoplastic products, including but not limited to fibers, yarns, fabrics (regardless of how formed, so as to include woven, knit and nonwoven fabrics and the like), etc. In addition, although the examples discussed below are all directed to polyester, the invention is not to be limited thereto, such examples being provided only for purposes of illustration. For example, the invention would be equally applicable to such thermoplastic materials as poly(trimethylene terephthalates) ("PTT"), polyamides, and nylons.

The textile products of the instant invention are processed prior to dyeing so as to minimize the amount of semi-crystalline phase regions contained therein. Based on the inventors' hypothesis that the semi-crystalline regions are not stably dyed, then the ideal molecular structure for optimally dyed fibers would be one in which there are substantially no semi-crystalline regions within the fibers. In other words, substantially all of the thermoplastic material forming the fibers would be either highly crystalline (and essentially undyeable) or amorphous (stably dyeable.)

In a preferred method of the invention, the attainment of the low percentage of semi-crystalline regions is achieved by pre-heatsetting the textile material at temperatures greater than those typically used to heatset the material. For example, it was found that by pre-heatsetting polyester at a temperature of greater than about 380° F., the amount of semi-crystalline regions could be effectively reduced. Even more preferably, polyester fabric would be treated so that it attains at least about 385° F., more preferably at least about 390° F., more preferably at least about 400° F., and even more preferably at least about 410° F.

Table I illustrates the effect on crystallization experienced by polyster fibers when they are heatset at the temperatures indicated:

TABLE I

| Temperature | % Highly Crystalline (approximate) | % Semi-Crystalline (approximate) | % Amorphous (approximate) |
|---|---|---|---|
| 280° F. | 51 | 33 | 16 |
| 375° F. | 59 | 8 | 33 |
| 390° F. | 61 | 2 | 37 |
| 410° F. | 62 | 0 | 38 |

The textile material is then dyed such as by a conventional jet dyeing process. The fabric is then desirably scoured such as by subjecting it to a reductive clear in a conventional manner. For example, the fabric can be processed through a bath of sodium hydroxide and sodium hydrosulfite to destroy the poorly attached dye molecules. The fabric is then rinsed to ensure the removal of the reducing agent and any loose but undestroyed dye molecules.

One phenomenon which the inventors recognized during the development of the invention was the tendency of fibers to crock after being taken up to high temperatures. As will be appreciated by those of ordinary skill in the art, crocking is the rubbing off of dye from a fabric as a result of insufficient dye penetration or fixation, the use of improper dyes or dyeing methods, or insufficient washing and treatment after the dyeing operation. It was discovered by the instant inventors that crocking was encouraged when a pre-heatset fabric was subsequently dyed and taken up to high temperatures. It is believed by the inventors that subjecting the fabrics to high temperatures subsequent to dyeing encourages movement of the dyestuff from the inside of the fibers to the outside (i.e. thermo-migration), which decreases the colorfastness of the dyed material. This suggested the importance of controlling thermomigration through controlling the temperature at which the fabrics were dried after dyeing and reductive clearing.

However, because the dyeing is performed at elevated temperatures, the drying temperature must be sufficient to remove wrinkles imparted during the dyeing process. For example, in jet dyeing the fabric is dyed at elevated temperatures while it is in a rope form of sorts. For example, jet dyeing of polyester fabrics is typically performed at about 265°–280° F. In test samples where fabric was pre-heatset at 375° F., dyed, then subsequently dried at temperatures of from about 250°–325° F. (Samples C–F below), the resulting fabrics were undesirably wrinkled. However, in the samples where the fabrics were heat treated at 390° F. and above prior to dyeing, the drying temperatures could be dramatically reduced without the undesirable impartation of wrinkles to the fabric. As a result, fabrics could be dried at very low temperatures so as to reduce the effects of thermo-migration as a result of the drying process.

In the finished materials of the invention, preferably less than about 8% of the fiber composition is in a semi-crystalline phase. Even more preferably, about 3% or less is semi-crystalline phase, even more preferably about 2% or less, and even more preferably less than about 1% semi-crystalline phase.

EXAMPLES

A plurality of substantially identical samples, constructed in the same manner, were dyed the same color and prepared as follows for purposes of comparison. Specifically, the fabrics were 2×2 right hand twill fabrics having 1/140/200 (ply/denier/filaments) type 56 polyester yarns in the warp and 1/150/100 type 56 polyester yarns in the fill. The warp yarns formed about 70% by weight of the fabric while the filling formed about 30% by weight of the fabric. The dyes used in each case were a mixture including 2.7200% on weight of goods (o.w.g.) C.1. Disperse yellow dye mixture, 0.3145% o.w.g. C.1. Disperse red 367, and 3.0000% o.w.g. C.1. Disperse violet 93, for an overall total dye percentage of 6.0345% o.w.g. Shades were evaluated according to the Hunter Lab Scan procedure (i.e. a standard photochromatic reading, as will be readily understood by those of ordinary skill in the art), and wash test and crock tests were performed on the samples according to AATCC Test Method 61-1996, and AATCC Test Method 8-1996, respectively. The results were recorded in Table II below.

Samples A and B

Samples A and B were prepared in a conventional manner by jet dyeing and post-heatsetting them at 375 degrees.

Sample C was pre-heatset at 375° F., jet dyed, then dried at 250° F. Fastness was increased over Samples A and B but wrinkles were present.

Sample D was pre-heatset at 375° F., jet dyed, then dried at 325° F. Fastness was lower than with Sample C, although wrinkling was reduced.

Sample E was pre-heatset at 375° F., jet dyed, then dried at 315° F. Fastness was lower than with Samples C and D, although wrinkling was reduced.

Sample F was pre-heatset at 375° F., jet dyed, then dried at 315° F. Fastness was improved over Samples A and B, but wrinkles were present.

Sample G was pre-heatset at 390° F., jet dyed, then dried at 250° F. Fastness was good and fabric was not wrinkled.

Sample H was pre-heatset at 390° F., jet dyed, then dried at 275° F. Fastness was good and fabric was not wrinkled.

Sample I was pre-heatset at 410° F., jet dyed, then dried at 250° F. Fastness was good and fabric was not wrinkled.

Sample J was pre-heatset at 410° F., jet dyed, then dried at 275° F. Fastness was good and fabric was not wrinkled.

Sample K was pre-heatset at 410° F., jet dyed, then dried at 275° F. Fastness was good and fabric was not wrinkled.

TABLE II

| | Shade out of jet | | | Shade after final pass | | | IIA Wash Test results | | | Crock Test | |
|---|---|---|---|---|---|---|---|---|---|---|---|
| Sample | DL | Da | Db | DL | Da | Db | Poly | Nylon | Cotton | Dry | Wet |
| A | .29 | .20 | −.29 | .03 | −.40 | −.27 | 2.5 | 1.5 | 3.5 | 2.5 | 4.0 |
| B | −.06 | −.04 | −.12 | −.21 | −.55 | −.27 | 2.5 | 1.5 | 3.5 | 2.5 | 3.5 |
| C | (Did not read) | | | (Visually weak/yellow) | | | 4.0 | 2.5 | 4.5 | 3.0 | 3.5 |
| D | (Did not read) | | | (Visually weak/yellow) | | | 2.5 | 2.0 | 3.0 | 2.5 | 4.0 |
| E | (Did not read) | | | (Visually weak/yellow) | | | 2.5 | 1.5 | 4.0 | 4.0 | 4.0 |
| F | 1.01 | −1.92 | 1.76 | 1.64 | −1.40 | 2.10 | 4.0 | 3.0 | 4.5 | 3.0 | 3.0 |
| G | −1.39 | 1.32 | .63 | −.68 | .17 | −.19 | 3.5 | 3.0 | 4.5 | 3.5 | 4.0 |
| H | −1.64 | .84 | .72 | −.78 | −.14 | −.15 | 3.0 | 2.5 | 4.0 | 3.5 | 4.0 |
| I | .91 | .15 | .15 | .39 | −.35 | .26 | 4.5 | 3.5 | 4.5 | 3.5 | 4.0 |
| J | 1.66 | −1.82 | 1.20 | 2.72 | −1.54 | 1.10 | 4.5 | 3.5 | 4.5 | 4.0 | 4.5 |
| K | .23 | −1.10 | .32 | 1.53 | −.65 | .22 | 4.5 | 4.0 | 4.5 | 4.0 | 4.5 |

A second round of tests was performed, with 100% polyester microdenier fiber-containing fabrics being dyed forest green and navy blue, respectively. Specifically, the fabrics were 2×2 right-hand twill fabrics having 1/160/200 polyester warp and fill yarns. The green fabric was dyed with a mixture including 2.7200% o.w.g. C.1. Disperse yellow dye mixture, 0.3145% o.w.g. C.1. Disperse red 367, and 3.0000% o.w.g. C.1. Disperse violet 93, for a total dye percentage of 6.0345% o.w.g. The navy fabric was dyed with a mixture including 0.8000% o.w.g. Disperse yellow dye mixture, 1.7310% o.w.g. C.1. Disperse red 367, and 4.3450% o.w.g. C.1. Disperse blue 284, for a total dye percentage of 6.7860% o.w.g. As will be readily appreciated by those of ordinary skill in the art, it is particularly difficult to obtain microdenier products having good colorfastness with these dark colors, with these large amounts of dye add-on. It has been found that the process of the invention achieves good results even when dye add-on percentages as high as 4%, 5%, 6%, 7%, 8%, 9%, and greater are utilized. (Samples at levels of from about 3.7% to upwards of 9% o.w.g. were tested and found to provide good colorfastness.)

A control piece of fabric, Sample L, was dyed forest green. The fabric was not heat treated prior to dyeing, but was heat treated after dyeing at 375° F.

Samples M, N, O, P, Q, R were all pre-heat set at 410° F., dyed forest green, and dried at 275° F. The shade of each sample was evaluated, and the fabrics were subjected to a Wash Test according to AATCC Test Method 61-1996. The fabrics were also subjected to a Crock Test according to AATCC Test Method 8-1996. The results are listed in the table below:

TABLE III

| | Shade to Standard | | | IIA Wash Test results | | | Crock Test | |
|---|---|---|---|---|---|---|---|---|
| Sample | DL | Da | Db | Poly | Nylon | Cotton | Dry | Wet |
| L | 0 | 0 | 0 | 2.5 | 1.5 | 3.5 | 2.5 | 3.5 |
| M | 1.55 | −.57 | .89 | 4.5 | 3.5 | 5.0 | 4.5 | 4.5 |
| N | 1.43 | −.52 | .47 | 4.5 | 3.0 | 4.5 | 4.0 | 4.5 |
| O | 1.53 | −.65 | .22 | 4.5 | 4.0 | 4.5 | 4.5 | 4.5 |

TABLE III-continued

| | Shade to Standard | | | IIA Wash Test results | | | Crock Test | |
|---|---|---|---|---|---|---|---|---|
| Sample | DL | Da | Db | Poly | Nylon | Cotton | Dry | Wet |
| P | 1.56 | −.06 | .63 | 4.5 | 3.0 | 5.0 | 4.0 | 4.0 |
| Q | .90 | .77 | −.39 | 3.5 | 2.5 | 4.5 | 3.0 | 3.5 |
| R | .83 | 1.00 | −.27 | 3.5 | 2.0 | 4.5 | 3.0 | 4.0 |

As indicated in the table, the samples which were pre-heatset according to the instant invention had dramatically superior colorfastness to that of the control Sample L. It was observed that Samples Q and R had inferior results to those of samples M, N, O and P. A review of the process indicated that Samples Q and R were subjected to the reducing agent separately from the other fabrics. It was then revealed that the afterclear process of Samples Q and R was inferior to that of the other fabrics, in particular because the reducing agent was allowed to oxidize too much before the fabrics were treated. From this the inventors were able to conclude that it is desirable that the dyed textile material be thoroughly cleared, in order that the loosely-held dye molecules will be freed.

Sample S was jet dyed navy blue and post heatset for stability at 375° F. Samples T, U, and V were pre-heatset at 410° F., jet dyed navy blue, then dried at 275° F. The results of the fabric are listed in Table IV below:

TABLE IV

| | Shade to Standard | | | IIA Wash Test results | | | Crock Test | |
|---|---|---|---|---|---|---|---|---|
| Sample | DL | Da | Db | Poly | Nylon | Cotton | Dry | Wet |
| S | 0 | 0 | 0 | 2.5 | 1.5 | 3.5 | 3.0 | 3.5 |
| T | 222 | 62 | 104 | 4.0 | 3.0 | 4.5 | 3.5 | 4.0 |

TABLE IV-continued

| | Shade to Standard | | | IIA Wash Test results | | | Crock Test | |
|---|---|---|---|---|---|---|---|---|
| Sample | DL | Da | Db | Poly | Nylon | Cotton | Dry | Wet |
| U | 163 | 3 | 106 | 4.5 | 3.5 | 5.0 | 3.5 | 4.0 |
| V | 149 | 10 | 185 | 4.5 | 3.0 | 4.5 | 3.0 | 4.0 |

As indicated in the table, the fabrics processed according to the instant invention achieved significantly better colorfastness than that of control Sample S. Preferably, the dyed fibers have a result of about 3.0 or greater on each wash test fiber when subjected to a Wash Test in accordance with AATCC Test Method 61-1996, and even more preferably, microdenier fibers achieve a result of about 3.0 or greater on each wash test fiber when subjected to a Wash Test in accordance with AATCC Test Method 61-1996.

In the specification there has been set forth a preferred embodiment of the invention, and although specific terms are employed, they are used in a generic and descriptive sense only and not for purpose of limitation, the scope of the invention being defined in the claims.

We claim:

1. A method of enhancing the colorfastness of dyed thermoplastic fibers comprising the steps of:

heatsetting thermoplastic fibers to minimize the amount of their molecular structure that is in a semi-crystalline state;

dyeing the fibers to achieve a desired color; and drying the fibers to thereby produce dyed fibers having about 8% or less of semi-crystalline phase and good colorfastness.

2. A method according to claim 1, wherein said step of dyeing comprises dyeing the fibers to equilibrium.

3. A method according to claim 1, wherein said fibers comprise microdenier fibers.

4. A method according to claim 1, further comprising the step of forming the fibers into a yarn prior to dyeing.

5. A method according to claim 2, further comprising the step of forming the fibers into a yarn prior to heatsetting.

6. A method according to claim 1, further comprising the step of forming the fibers into a fabric prior to dyeing.

7. A method according to claim 1, further comprising the step of forming the fibers into a textile fabric prior to heatsetting.

8. A method according to claim 1, further comprising the step of scouring the fibers subsequent to said step of dyeing, to thereby remove excess dye therefrom.

9. A method according to claim 1, wherein said fibers are polyester fibers and said step of heatsetting is performed so that said fibers attain a temperature of about 385° F. or greater.

10. A method according to claim 9, wherein said fibers attain a temperature of about 390° F. or greater.

11. A method according to claim 10, wherein said fibers attain a temperature of about 400° F. or greater.

12. A method according to claim 11, wherein said fibers attain a temperature of about 410° F. or greater.

13. A method according to claim 1, wherein said step of drying is performed at a temperature of about 300° F. or less.

14. A method according to claim 9, wherein said step of drying is performed at a temperature of about 300° F. or less.

15. A method according to claim 1, wherein said step of drying is performed at a temperature of at least about 25% less than the temperature used for heatsetting said fibers.

16. A method according to claim 1, wherein about 5% or less of the molecular structure is in a semi-crystalline state.

17. A method according to claim 1, wherein about 2% or less of said molecular structure is in a semi-crystalline state.

18. A method according to claim 1, wherein less than about 1% of said molecular structure is in a semi-crystalline state.

19. A method according to claim 1, wherein substantially all of the molecular structure is in a highly crystalline or amorphous molecular state prior to said dyeing step.

20. A method according to claim 1, wherein at least about 45% of the molecular structure of said fibers is highly crystalline and at least about 30% is amorphous.

21. Dyed thermoplastic fibers made according to the method of claim 1.

22. A method according to claim 1, wherein said dyed fibers have a result of about 3.0 or greater on each wash test fiber when subjected to a Wash Test in accordance with AATCC Test Method 61-1996.

23. A method according to claim 1, wherein said step of dyeing comprises dyeing the fibers at a dye level of about 4% on weight of goods or greater.

24. A method according to claim 23, wherein said step of dyeing comprises dyeing the fibers at a dye level of about 6% on weight of goods or greater.

25. A method according to claim 24, wherein said step of dyeing comprises dyeing the fibers at a dye level of about 8% on weight of goods or greater.

26. A method according to claim 25, wherein said step of dyeing comprises dyeing the fibers at a dye level of about 9% on weight of goods or greater.

27. Dyed textile fibers having about 8% or less semi-crystalline phase and a colorfastness result of about 3.0 or greater on each wash test fiber type when subjected to a Wash Test in accordance with AATCC Test Method 61-1996.

28. Dyed textile fibers according to claim 27, wherein said fibers have a dye add-on percentage of about 4% or greater on weight of goods.

29. Dyed textile fibers according to claim 27, wherein said fibers have dye add-on percentage of about 6% or greater on weight of goods.

30. Dyed textile fibers according to claim 27, wherein said fibers have a dye add-on percentage of about 8% or greater on weight of goods.

31. Dyed textile fibers according to claim 27, wherein said fibers have about 5% or less of semi-crystalline phase.

32. Dyed textile fibers according to claim 31, wherein said fibers have a dye add-on percentage of about 4% or greater on weight of goods.

33. Dyed textile fibers according to claim 31, wherein said fibers have a dye add-on percentage of about 6% or greater on weight of goods.

34. A method according to claim 1, wherein said step of dyeing comprises jet dyeing.

35. Dyed textile fibers according to claim 27, wherein said fibers comprise fibers selected from the group consisting of polyesters, poly(trimethylene terephthalates), polyamides, and nylons.

36. Dyed textile fibers according to claim 35, wherein said fibers comprise fibers about 1 denier per filament in size or smaller.

37. Dyed textile fibers according to claim 27, wherein said fibers comprise fibers about 1 denier per filament in size or smaller.

38. Dyed textile fibers according to claim 27, wherein said fibers are in the form of a textile fabric.

39. A textile fabric comprising microdenier fibers having about 8% or less of semi-crystalline phase, said fabric having a colorfastness result of about 3.0 or greater on each wash test fiber type when subjected to a Wash Test in accordance with AATCC Test Method 61-1996.

40. A textile fabric according to claim 39, wherein said microdenier fibers are polyester.

41. A textile fabric according to claim 39, wherein said fabric has a dye add-on percentage of about 4% or greater on weight of goods.

42. A method according to claim 8, wherein said step of scouring comprises subjecting the fibers to a reductive clear.

* * * * *